US007847143B2

(12) United States Patent
Moramarco et al.

(10) Patent No.: US 7,847,143 B2
(45) Date of Patent: Dec. 7, 2010

(54) DANCER'S PROTECTIVE FOOT PAD

(76) Inventors: Katrina L. Moramarco, 129 W. Badillo St., Covina, CA (US) 91723-2016; Joseph A. Avignone, 7709 Shore Rd., Brooklyn, NY (US) 11209

( * ) Notice: Subject to any disclaimer, the term of this patent is extended or adjusted under 35 U.S.C. 154(b) by 40 days.

(21) Appl. No.: 11/973,146

(22) Filed: Oct. 5, 2007

(65) Prior Publication Data

US 2009/0090028 A1 Apr. 9, 2009

(51) Int. Cl.

| | |
|---|---|
| ***A61F 13/00*** | (2006.01) |
| ***A61F 13/06*** | (2006.01) |
| ***A61F 5/30*** | (2006.01) |
| ***A43B 5/12*** | (2006.01) |
| ***A43B 13/22*** | (2006.01) |
| ***A43B 7/26*** | (2006.01) |

(52) U.S. Cl. ..... 602/41; 602/52; 602/54; 602/57; 128/893; 128/894; 128/112.1; 36/8.3; 36/94; 36/73

(58) Field of Classification Search ..... 602/41, 602/42, 52–54, 57, 900, 904; 36/8.3, 73, 36/94; 128/894, 112.1, 892, 893
See application file for complete search history.

(56) References Cited

U.S. PATENT DOCUMENTS 1,308,483 A 1/1919 Craighead (Continued)

FOREIGN PATENT DOCUMENTS

DE 30 40 496 6/1982

(Continued)

OTHER PUBLICATIONS

"3M Hi-Tack Transfer Adhesive, Product No. 1504," 3M Company, Sep. 2006.

(Continued)

*Primary Examiner*—Patricia M Bianco
*Assistant Examiner*—Victoria Hicks
(74) *Attorney, Agent, or Firm*—David M. Quinlan, P.C.

(57) ABSTRACT

A protective foot pad includes a sheet of protective material having a main body portion in the shape of the ball of a human foot and a locating tab extending from the main body portion for location between the first and second toes of the foot, an adhesive on one surface of the sheet for adhering the sheet to the foot, and a removable release liner covering the adhesive until the pad is to be adhered to the foot. The pad is especially suited for protecting the bare foot of a dancer, who will use the pad by removing the release liner to expose the adhesive, placing the exposed adhesive on the bottom of his or her foot to cover at least a portion of the ball of the foot, with the tab extending between the first and second toes, and bending the locating tab over the skin between the first and second toes. The main body portion can include one or more lateral extensions that adhere to the side of the foot. In one embodiment, the adhesive is a layer of material that is adhesive on both surfaces thereof, one of which has the releasable liner thereon. The other surface of the layer of material is disposed on an adhesive surface of the sheet, which is a non-woven, open-matrix, polyester layer.

18 Claims, 3 Drawing Sheets

U.S. PATENT DOCUMENTS

| | | | | | |
|---|---|---|---|---|---|
| 1,395,958 | A | | 11/1921 | Hamilton | |
| 1,452,302 | A | | 4/1923 | Loven | |
| 1,836,624 | A | * | 12/1931 | Sothen | 36/8.3 |
| 2,237,652 | A | | 4/1941 | Capezio | |
| 2,248,303 | A | | 7/1941 | Morgenroth et al. | |
| 2,572,152 | A | | 10/1951 | Horlacher | |
| 2,797,688 | A | * | 7/1957 | Crawford | 602/30 |
| 2,978,818 | A | * | 4/1961 | Baumann | 36/145 |
| 3,253,591 | A | * | 5/1966 | Scholl | 128/894 |
| 3,316,663 | A | * | 5/1967 | Neu | 36/71 |
| 3,802,318 | A | * | 4/1974 | Sibbald | 91/4 R |
| 4,207,880 | A | * | 6/1980 | Zinkovich | 602/30 |
| 4,277,897 | A | | 7/1981 | O'Connell | |
| 4,651,354 | A | | 3/1987 | Petrey | |
| 6,018,888 | A | | 2/2000 | Wilkenfeld et al. | |
| 6,592,889 | B1 | * | 7/2003 | Stout et al. | 424/443 |
| 6,640,465 | B1 | | 11/2003 | Burgess | |
| 6,802,318 | B1 | * | 10/2004 | Parker | 128/882 |
| 6,881,196 | B2 | * | 4/2005 | Crunkleton | 602/5 |
| 7,007,309 | B1 | | 3/2006 | Mende et al. | |
| D520,217 | S | | 5/2006 | Kim | |
| 7,051,457 | B1 | | 5/2006 | Huggins et al. | |
| 7,107,626 | B1 | | 9/2006 | Andrews | |
| 7,217,853 | B2 | * | 5/2007 | Kulichikhin et al. | 602/41 |
| 2002/0218580 | | | 9/2002 | Carlson et al. | |
| 2003/0168118 | A1 | | 9/2003 | Metzger | |
| 2006/0034905 | A1 | * | 2/2006 | Singh et al. | 424/449 |
| 2006/0041211 | A1 | * | 2/2006 | Hawkinson et al. | 602/41 |
| 2006/0107444 | A1 | | 5/2006 | Huggins | |
| 2006/0179549 | A1 | | 8/2006 | Huggins et al. | |
| 2006/0196078 | A1 | | 9/2006 | Terlizzi et al. | |

FOREIGN PATENT DOCUMENTS

| | | |
|---|---|---|
| GB | 2378891 | 2/2003 |
| JP | 11-332602 | 12/1999 |
| JP | 2001/32116 | 2/2001 |
| JP | 2001/21879 | 8/2001 |
| WO | WO99/51117 | 10/1999 |

OTHER PUBLICATIONS

"Technical Information Sheet, Product No. 9916, 3M Medical Tan Nonwoven Tape," 3M Company, Jan. 2004.

"Product Clinical Data Summary, No. 9916, 3M Spunlace Tape," 3M Company, Apr. 2003.

"Preliminary Technical Data Sheet, Product No. 1504 (formerly MSX-6069 and MSX-6082), 3M Hi-Tack Medical Transfer Adhesive," May 2005.

"Product Clinical Data Summary, 3M No. 1504, 3M Hi-Tack Transfer Adhesive," Aug. 2005.

"3M Material Safety Data Sheet," 3M Spunlace Nonwoven Tape 9916, 3M Company, Sep. 9, 2003.

* cited by examiner

DANCER'S PROTECTIVE FOOT PAD

BACKGROUND OF THE INVENTION

1. Field of the Invention

The present invention relates to a protective foot pad, and more particularly, to an inexpensive, easily applied and removed, disposable foot pad for a dancer that is largely invisible to an audience during a performance by the dancer.

2. Description of Related Art

Many performances, particularly so-called modern dances, rely for part of their effect on the perception that the performer is barefoot. However, to dance with no foot protection can cause injuries such as blisters, friction burns, skin tears, and splinters. Obviously, these types of injuries can be serious for dancers, who must take special care of their feet. In addition, dancing barefoot increases the risk of slipping or falling. The drawbacks of some of the prior attempts at providing foot protection for dancers that avoids these problems are discussed in U.S. Pat. No. 7,051,457.

Prior foot protectors appear to fall into two broad types. The first uses some form of truncated stocking with a floor contacting surface. This type is shown in U.S. Pat. No. 7,051,457, as well as U.S. Patent Publs. Nos. 2006/0107444, 2006/0179549, and 2006/0196078. Similar types of footwear, although not necessarily intended specifically for dancers, are shown in U.S. Pat. Nos. 1,308,483, 1,452,302, 2,248,303, 2,572,152, 4,651,354, and 7,107,626, and in UK Patent Appln. No. 2,378,891. The second type of prior protective footwear for dancers is secured to the foot by straps that hold a protective pad in place at the desired location on the foot. This type of protective footwear is shown in U.S. Pat. Nos. 2,237,652, 4,277,897, 6,018,888, and D520,217, and WO99/51117.

Both types of foot protectors are generally effective in avoiding problems encountered by dancing barefoot. However, they have drawbacks. For one thing, they are relatively expensive to be discarded after only one use, especially for recreational dancers, which means that either they must be worn even though they are soiled or they must be cleaned frequently. Another drawback is that they can be seen by an audience during a performance, which detracts from the esthetic value of the dance. And straps that hold the footwear in place can themselves cause blisters.

There are hand and foot shields that can adhere directly to the skin, examples of which are shown in U.S. Pat. No. 6,640,465, German Patent No. DE 30 04 496, and Japanese Laid-Open Applns. Nos. 11-332602, 200132116, and 2001-218789. In addition, there are numerous compositions for sheets that adhere directly to the skin, such as those described in U.S. Pat. No. 7,217,853 and U.S. Patent Publs. No. 2003/0168118 and No. 2006/0034905. However, none of these products are constructed for use as disposable foot protectors for dancers (or others who require foot protection of a similar nature, such as gymnasts, those practicing martial arts, etc.).

SUMMARY OF THE INVENTION

It is an object of the present invention to provide an inexpensive, disposable protective foot pad specially constructed for use by anyone needing foot protection, such as dancers, gymnasts, those practicing martial arts, etc.

It is another object of the invention to provide a foot pad that adheres directly to a bare foot and is virtually invisible to observers when in use.

In accordance with a first aspect of the invention, a protective foot pad comprises a sheet of protective material having a main body portion in the shape of the ball of a human foot and at least one locating tab extending from the main body portion for location between two toes of the foot, an adhesive on one surface of the sheet for adhering the sheet to the foot, and a removable release liner covering the adhesive until the pad is to be adhered to the foot. In further aspects of the invention, a single tab is located for positioning between the first and second toes, and a plurality of tabs are located for positioning between other pairs of toes.

In accordance with another aspect of the invention, a method of protecting a user's foot includes providing a protective pad comprising a sheet of protective material having a main body portion in the shape of the ball of a human foot and at least one locating tab extending from the main body portion, an adhesive on one surface of the sheet for adhering the sheet to the foot, and a removable release liner covering the adhesive, removing the release liner to expose the adhesive, placing the exposed adhesive on the bottom of the foot to cover at least a portion of the ball of the foot with the locating tab extending between two toes, and bending the locating tab over the skin between the toes and adhering the tab thereto.

In accordance with still another aspect of the invention, a method of making a protective foot pad includes providing a sheet of non-woven, open-matrix polyester material larger than the finished pad, one surface of the sheet having an adhesive thereon, providing an adhesive layer that is adhesive on both surfaces thereof, the adhesive layer having a removable release liner on one surface thereof coextensive with the adhesive layer, placing the surface of the adhesive layer without the release liner in contact with the adhesive surface of the sheet to form a pad blank, and cutting at least one pad in the shape of the ball of a human foot.

In a preferred embodiment, the pad comprises a non-woven, open-matrix, polyester layer, one surface thereof being adhesive, which can be 3M™ spunlace, polyester, nonwoven tape, and a layer of material disposed on the adhesive surface of the polyester layer, which can be 3M™ hi-tack synthetic, rubber-based two-sided transfer adhesive with the release liner on one surface thereof The pad may optionally include an additional cushioning layer.

BRIEF DESCRIPTION OF THE DRAWINGS

The objects of the invention will be better understood from the detailed description of its preferred embodiments which follows below, when taken in conjunction with the accompanying drawings, in which like numerals and letters refer to like features throughout. The following is a brief identification of the drawing figures used in the accompanying detailed description.

One skilled in the art will readily understand that the drawings are not strictly to scale, but nevertheless will find them sufficient, when taken with the detailed descriptions of preferred embodiments that follow, to make and use the present invention.

DETAILED DESCRIPTION OF PREFERRED EMBODIMENTS

Figure 1A:
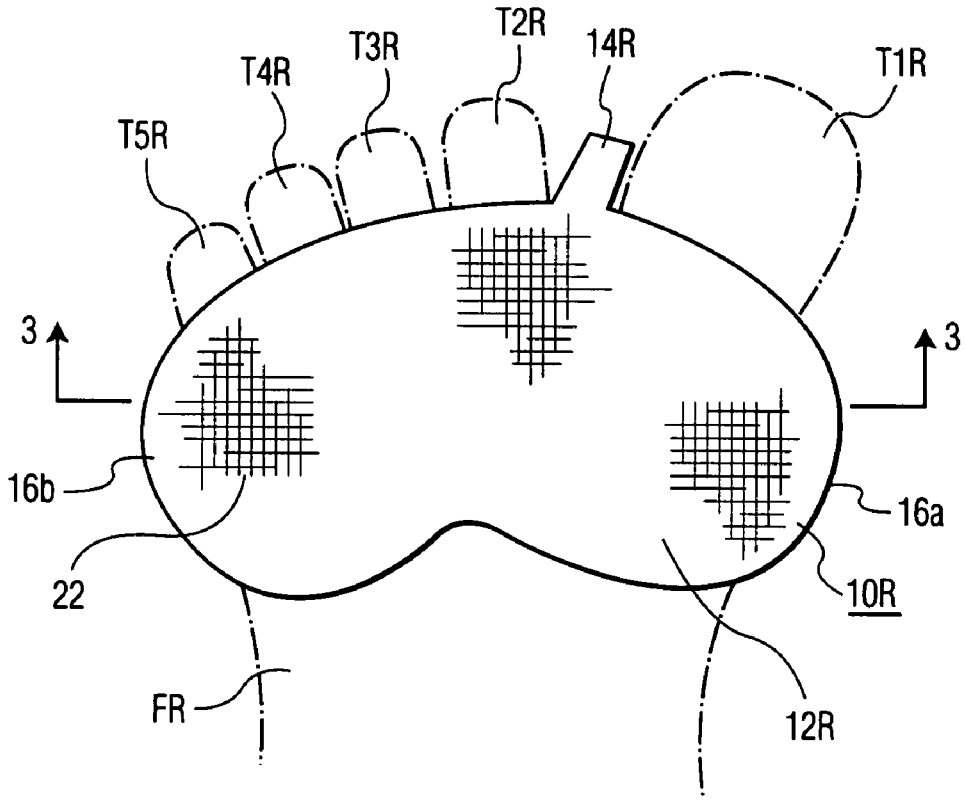
FIG. 1A is a plan view of a right foot pad in accordance with a preferred embodiment of the invention.
Figure 1B:
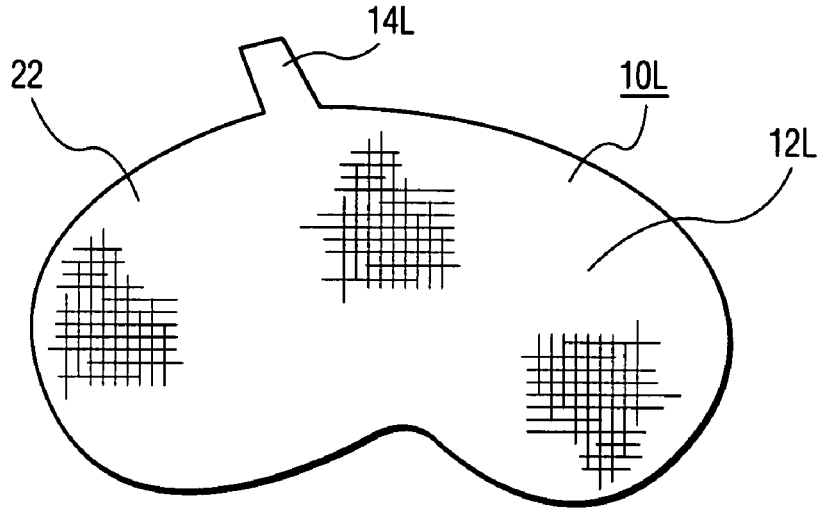
FIG. 1B is a plan view of a left foot pad in accordance with a preferred embodiment of the invention.

FIGS. 1A and 1B respectively depict a pad 10R for the right foot and a pad 10L for the left foot, in accordance with an embodiment of the invention. It will be appreciated that the pads 10R and 10L are generally mirror images of each other. In this description, the same reference numerals will be used to denote like components of the pads, with an "R" suffix denoting right and an "L" suffix denoting left. The pads are shown relative to the bottom of the right foot LR and the left foot LF (depicted in phantom lines) to illustrate their relationship to the feet before being adhered thereto for use. Each pad includes a sheet of protective material having a main body portion 12 that is slightly wider laterally than the ball of the foot on which the pad is to be used. One surface of the sheet has an adhesive layer thereon for adhering the pad directly to the user's foot. A preferred laminated sheet construction is described in more detail below in connection with FIG. 3.

It is important that the pad 10 be properly positioned on the ball of the foot for maximum protection. To that end, the sheet of material includes a locating tab 14. The tab is located relative to the main body portion 12 so that when the tab is placed between the first (big) toe T1 and the second toe T2, the pad will be positioned correctly on the ball of the foot. (The remaining toes T3, T4, and T5 are shown for completeness.) The locating tab 14 need not be used in all embodiments of the invention, but it will be appreciated that it is difficult for a user to get his or her foot in a position providing a good angle for accurately viewing where the pad is located relative to the ball of the foot before applying it. Accordingly, the locating tab 14 assists the dancer in accurately placing the pad without help from another person.

Figure 2A:
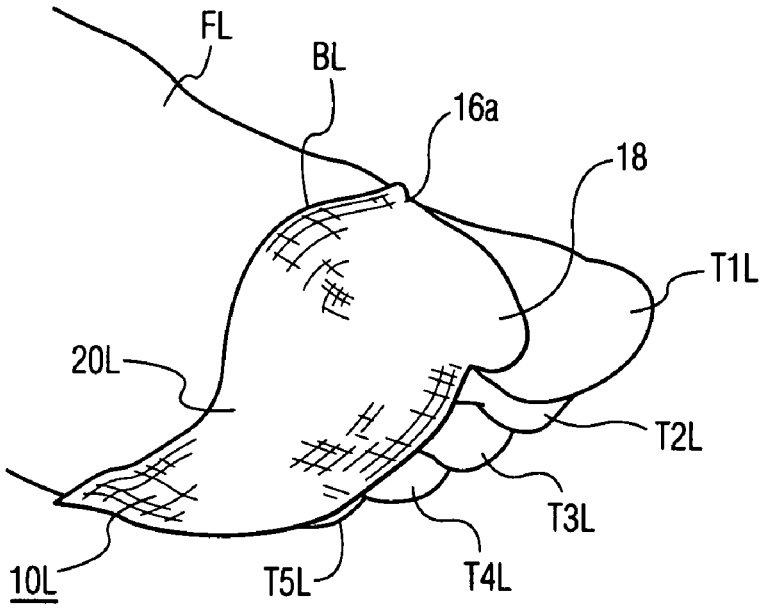
FIG. 2A is a perspective view of the left foot pad in place for use.
Figure 2B:
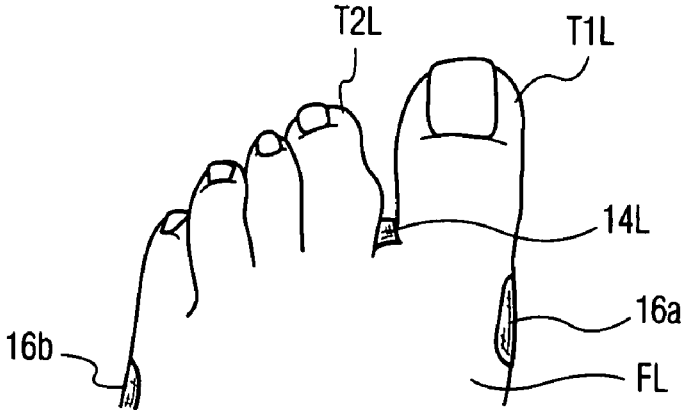
FIG. 2B shows a top view of the pad in place adhered to a foot illustrating the placement of the locating pad that is a feature of the illustrated embodiment of the invention.

FIGS. 1A and 1B show the main body portion 14 having lateral extensions 16*a* and 16*b* that make the main body portion as slightly wider than the ball of the ball of the user's foot. The purpose of this feature of the depicted embodiment of the invention is illustrated better in FIG. 2. FIG. 2A is a perspective view that shows the left foot pad 10L in place on the ball of the foot. It illustrates particularly the extension 16*a* that protects the outside of the foot by wrapping around it to a suitable extent. FIG. 2B is a top view of the foot in FIG. 2A for showing the position of the locating tab 14 when the pad is applied to the foot. The second toe T2 in FIG. 2B is shown separated from the first toe T1 to enable the tab 14 to be readily seen in the drawing. Normally, the toes will be much closer together and make the locating tab 14 virtually invisible when the pad is in use. FIG. 2B also shows the extension 16*b* at the outside part of the foot. In other embodiments of the invention, the main body portion may not include the lateral extensions, or have only one of them.

The extensions 16*a* and 16*b*, which need not be incorporated in all embodiments of the invention, should wrap only along the sides of the foot. If they extend too far, they will be more prone to peeling off during strenuous movements by the user, in addition to being potentially visible to an audience. On the other hand, the extensions 16*a* and 16*b* assist in firmly adhering the pad to the user's foot, and it is preferred that the pad include the extensions 16*a* and 16*b* because they assist in holding the pad in place. It is important that the dimensions of the pad, including the extensions 16*a* and 16*b*, be correctly matched to the size of the user's foot, otherwise the pad can become dislodged from the user's foot during strenuous activity. In that regard, one of the advantages of the present invention is that the pad can be trimmed to the optimum size based on the user's experience. That is, after a certain number of pads have been used, they can be trimmed to the precise configuration that is best for that user's foot.

FIG. 2A also illustrates another feature of the illustrated embodiment of the invention. The main body portion 12 in this embodiment is configured so that when the locating tab is properly placed, a part of the main body portion forms a toe protector 18 that adheres to the bottom of the first toe for additional protection. This also provides another area where the pad is adhered to the user's foot.

Figure 3:
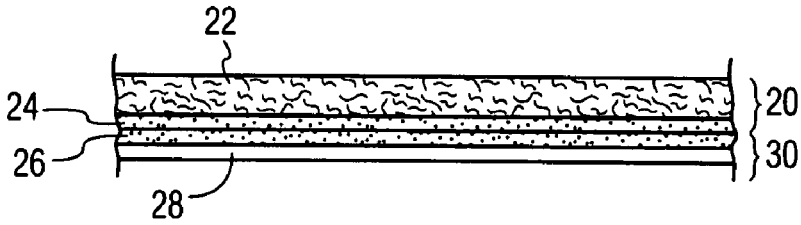
FIG. 3 is a cross-sectional view taken along line 3-3 in FIG. 1A showing a preferred construction of a foot pad in accordance with the present invention.

FIG. 3 illustrates a preferred construction of the pad 10 of the present embodiment. FIG. 3 is a cross-section taken along lines 3-3 in FIG. 1A, and shows the two-part laminated construction of this embodiment. The protective material 20 of the pad includes a non-woven, open-matrix, polyester material 22 that provides the surface for contacting the floor and protecting the dancer's foot when the pad is in use. In the present embodiment, the protective layer 20 also includes an adhesive 24 on the other surface of the polyester layer. The laminate construction includes an adhesive layer 26 that is adhesive on both of its surfaces and a release liner 28 disposed on the adhesive layer.

The pad 10 can conveniently be fabricated by using as the protective layer 22 a commercially available product such as 3M™ spunlace, polyester, nonwoven tape. One surface of the tape has thereon an acrylate adhesive, which in turn is protected by a poly-coated Kraft paper liner (not shown) with a silicone release composition. It is described in detail in 3M's "Technical Information Sheet, Product Number 9916" (2004), which is incorporated by reference herein. The adhesive layer 26 and release liner 28 are also most conveniently a commercially available product sold as a laminate 30 of the release liner 28 and a double-sided adhesive 26 adapted specially to provide a secure bond with human skin, and should preferably be a very aggressive synthetic rubber-based adhesive provided with the release liner on one surface. One such product that has been found suitable is 3M™ hi-tack transfer adhesive, which is sold in roll form and is described in detail in 3M's flyer "Hi-Tack Transfer Adhesive, Product No. 1504" (September 2006), which is incorporated by reference herein. It will be appreciated that a pad with this construction can be easily trimmed to size with conventional fabric scissors.

Fabricating a pad in accordance with a preferred method employs a sheet of the product intended as the protective layer that is larger than the finished pad. For most efficient manufacture, the sheet will be larger than the surface area of several pads. The Kraft paper liner is removed to expose the adhesive 24. A suitable amount of the laminate 30 is removed from the roll on which it is provided, and the thus-exposed adhesive 24 is then brought into intimate contact with an exposed expanse of the adhesive layer 26. Following this fabrication of a blank of the laminated construction shown in FIG. 3, a number of pads can be cut out from the blank by stamping or any other suitable manufacturing process. It is contemplated that a number of sizes of pads will be made available for purchase to fit different size feet. It will be understood to be within the scope of the invention to provide uncut sheets of the laminated construction shown in FIG. 3 that a user can cut to a desired size to fit his or her feet. In addition, the pad can be provided in different colors to more closely match the color of different users' feet. It is also within the scope of the invention to provide a sheet in which the layers 22, 24, and 26 are perforated in the shape of the foot pads 10R and 10L shown in FIGS. 1A and 1B, so that the release liner 28 provides a supporting matrix from which the foot pads can be peeled just prior to use.

In using a pad according to the present invention, the dancer will first insure that his or her feet are clean and dry. A commercial form of the invention can be sold with an alcohol swab to maximize the effectiveness of the aggressive adhesive that is used in the adhesive layer 26. (If sold as separate pieces, the pads will be provided in pairs for the left and right feet.) The dancer will then separate the pad 10 from the release liner 28 and position the pad on the ball of the foot by placing the tab 14 between the first and second toes as discussed above. The main body portion 12 will be pressed against the ball of the foot over its entire extent and, if the pad is large enough, along the sides of the dancer's foot and under the first toe as shown in FIG. 2. The locating tab is folded up between the first and second toes and secured firmly to the skin there. These instructions can be conveniently printed on the back of the release liner 28 for the user's ease of reference. It is also possible to provide the pads as a single sheet on which lines are printed in the shape of pads to enable the user to cut the pads from the sheet just prior to use.

Figure 4:
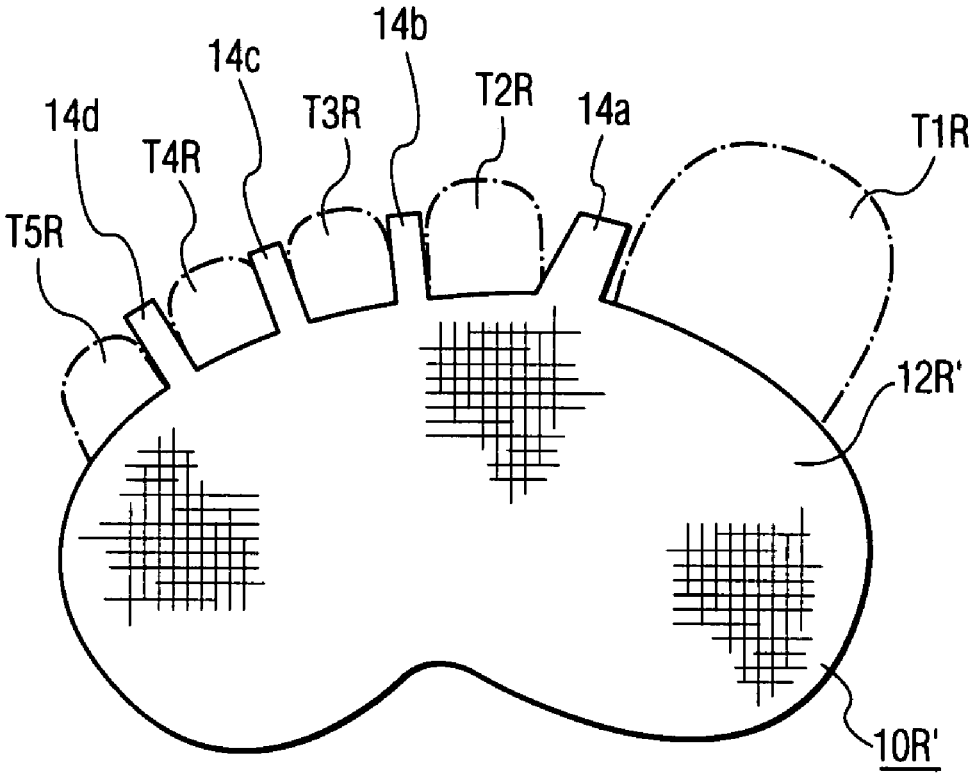
FIG. 4 is a plan view of a right foot pad according to another preferred embodiment of the invention.

FIG. 4 shows an alternate embodiment of the pad identified by reference numeral 10R', having multiple locating tabs 14*a*, 14*b*, 14*c*, and 14*d*. The tab 14*a* of this embodiment corresponds to tab 14R shown in FIG. 1A. Tab 14*b* is located relative to the main body portion 12R' of the pad so that when the pad is correctly positioned on the ball of the user's foot, the tab 14*b* is between the user's second toe T2 and third toe T3. The tabs 14*c* and 14*d* are likewise located on the pad so that they line up with the spaces between the user's third and fourth toes (T3 and T4) and fourth and fifth toes (T4 and T5), respectively. The tabs 14*a*-14*d* have extended lengths to make it easier for the user to pull them through the spaces between the toes from the top of the foot. Once the tabs are positioned between the toes, they can be trimmed to the proper length to permit them to adhere firmly to the user's foot without being unduly visible (as in FIG. 2B). This embodiment facilitates use of the pad, provides more reference points (the multiple tabs) for properly positioning the pad on the ball of the user's foot, and more securely attaches the pad to the user's foot. FIG. 4 illustrates a right-foot pad, but it will be understood that the left-foot pad will have the same features.

Figure 5:
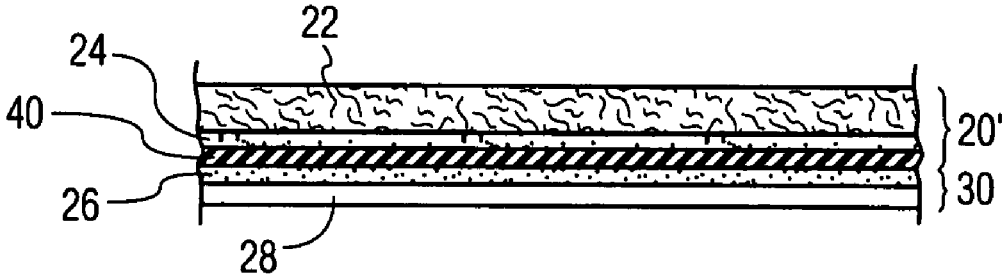
FIG. 5 is a cross-sectional view corresponding to FIG. 3, showing an alternate construction of the foot pad in accordance with the present invention.

FIG. 5, a cross-sectional view corresponding to FIG. 3, shows an alternate construction of the pad. The protective layer 20' of the construction shown in FIG. 5 includes an additional cushioning layer 40 that provides extra protection to the user's foot. The cushioning layer can be made of any suitable material, such as a silicone rubber, a gel, or other shock absorbing composition. One surface of the cushioning layer 40 can be adhered to the adhesive 24, and the adhesive layer 26 is in turn is adhered to the other surface of the cushioning layer. This construction can be used with any pad configuration.

It will be appreciated that the pad 10 will provide excellent protection for a dancer's feet by reducing the resistance to movement across the floor. It will inhibit the formation of calluses, as well as protecting any blisters or calluses that are already present from becoming more severe. Because the pad is inexpensive (especially compared to existing foot-protection products for dancers), it can be discarded after one use. As noted above, this eliminates the need for cleaning between uses and further increases the convenience to the user. It also makes effective foot protection more readily available to recreational dancers. Finally, because it only covers the bottoms of the dancer's feet (or, at most, the bottoms and a small portion of the sides of the feet), the pad is largely invisible to an audience during a performance, and thus does not distract from the effect intended by the choreographer in creating a dance meant to be performed barefoot. In that regard, if the pad embodiment with one or more tabs is used, the tab(s) will not be visible between the toes. Moreover, the product becomes even more "invisible" during use, as any residue from the dance floor is picked up by both the dancer's feet and the pad as the dance proceeds, so that even if the bottoms of the dancer's feet should be momentarily visible the pad is not seen.

In addition, the foot pad of the present invention, while having exceptional utility for dancers, is not limited to that particular application. One other example of a potential users are gymnasts, who often perform dance-like movements during free programs. In addition, those engaging in martial arts contests or exhibitions will also find the present invention useful for protecting their feet. Of course, other uses will be apparent to those skilled in the art, and the invention is specifically not intended to be limited to use only in the environments specifically mentioned.

Those skilled in the art will readily recognize that only selected preferred embodiments of the invention have been depicted and described, and it will be understood that various changes and modifications can be made other than those specifically mentioned above without departing from the spirit and scope of the invention, which is defined solely by the claims that follow.

What is claimed is:

1. A protective foot pad for use by a human during an activity including dancing, gymnastics, or martial arts, the foot pad comprising a flat sheet of protective material, wherein:

said sheet of protective material includes a portion comprising a main body of said pad in the shape and general size of the ball of a human foot and at least one other portion comprising at least one flat locating tab extending from said main body portion, said at least one locating tab being positioned relative to said main body for location between two toes of the foot;

one surface of said sheet has an adhesive thereon for adhering said sheet to the foot and a removable release liner covering said adhesive until said pad is to be adhered to the foot by said adhesive;

said at least one locating tab is disposed relative to said main body portion to properly position said main body portion over the ball of the foot when said at least one locating tab is positioned between the two toes; and said at least one locating tab is dimensioned to fold up and over to adhere to the skin between and connecting the toes using said adhesive, said at least one locating tab being disposed between the toes without extending over the tops of the toes and being substantially hidden from an observer of the activity when said main body portion is properly positioned over the ball of the foot.

2. A protective foot pad as in claim 1, wherein:

said sheet comprises a non-woven, open-matrix, polyester layer, one surface thereof being adhesive;

said adhesive comprises a layer of material that is adhesive on both surfaces thereof and is disposed on said adhesive surface of said polyester layer, said layer of material being coextensive with said polyester layer; and said release liner is disposed on one surface of said layer of material and is coextensive therewith.

3. A protective foot pad as in claim 2, wherein said main body portion includes at least one lateral extension dimensioned to extend a distance that at least partially covers a side of the foot when the pad is in use, said extension being adhered to the foot by said adhesive.

4. A protective foot pad as in claim 3, wherein said main body portion includes two said lateral extensions, each being dimensioned to extend a distance that partially covers an opposite side of the foot when the pad is in use, said extensions being adhered to the foot by said adhesive.

5. A protective foot pad as in claim 2, wherein said polyester layer is spunlace, polyester, nonwoven tape and said layer of material is a hi-tack synthetic, rubber-based two-sided transfer adhesive with said release liner on one surface thereof.

6. A protective foot pad as in claim 2, wherein said sheet further comprises a cushioning layer adhered to said polyester layer and disposed between said polyester layer and said adhesive.

7. A protective foot pad as in claim 1, wherein said at least one locating tab is positioned relative to said main body portion for location between the first and second toes of the foot.

8. A protective foot pad as in claim 7, wherein said at least one locating tab includes a plurality of said locating tabs positioned relative to said main body portion for location between other pairs of toes of the foot.

9. A protective foot pad as in claim 1, wherein said sheet of protective material is a single sheet.

10. A method of protecting a human user's foot during an activity including dancing, gymnastics, or martial arts, the method including:

providing a protective pad comprising a flat sheet of protective material including a portion comprising a main body of said pad in the shape and general size of the ball of a human foot and at least one other portion comprising at least one flat locating tab extending from said main body portion, an adhesive on one surface of said sheet for adhering said sheet to the foot, and a removable release liner covering said adhesive, wherein said at least one locating tab is disposed relative to said main body portion to properly position said main body portion over the ball of the foot when said at least one locating tab is positioned between the two toes, said at least one locating tab being dimensioned to fold up and over to adhere to the skin between and connecting the toes when said main body portion is properly positioned over the ball of the foot;

removing said release liner to expose said adhesive;

placing said exposed adhesive on the bottom of the human user's foot to cover at least a portion of the ball of the foot with said at least one locating tab extending between two toes; and folding said at least one locating tab up and over the skin between and connecting the two toes and using said adhesive to adhere said at least one locating tab to the skin between and connecting the two toes without extending over the tops of the toes so as to be substantially hidden from an observer of the activity.

11. A method as in claim 10, wherein:

said sheet comprises a non-woven, open-matrix, polyester layer, one surface thereof being adhesive;

said adhesive comprises a layer of material that is adhesive on both surfaces thereof and is disposed on said adhesive surface of said polyester layer, said layer of material being coextensive with said polyester layer; and said releasable liner is disposed on one surface of said layer of material and is coextensive therewith.

12. A method as in claim 11, wherein said polyester layer is spunlace, polyester, nonwoven tape and said layer of material is a hi-tack synthetic, rubber-based two-sided transfer adhesive with said release liner on one surface thereof.

13. A method as in claim 12, wherein said locating tab is positioned relative to said main body portion for location between the first and second toes of the foot.

14. A method as in claim 13, wherein said at least one locating tab includes a plurality of said locating tabs positioned relative to said main body portion for location between other pairs of toes of the foot.

15. A method as in claim 14, wherein said locating tabs are longer than required to adhere only to the skin between and connecting the respective pairs of toes and the method further includes trimming any excess length from a said one locating tab prior to finally adhering said trimmed locating tab to the skin between and connecting a corresponding pair of toes.

16. A method as in claim 10, wherein: said main body portion includes at least one lateral extension wider than the ball of the foot for extending a distance that partially covers a side of the foot; and said placing step further includes adhering said lateral extension to the foot using said adhesive.

17. A method as in claim 10, wherein said at least one locating tab is longer than required to adhere only to the skin between and connecting the toes and the method further includes trimming any excess length from said at least one locating tab prior to finally adhering said at least one locating tab to the skin between and connecting the toes.

18. A method as in claim 10, wherein said sheet of protective material is a single sheet.

* * * * *